US006176345B1

(12) United States Patent
Perkins et al.

(10) Patent No.: US 6,176,345 B1
(45) Date of Patent: Jan. 23, 2001

(54) PISTONIC MOTION, LARGE EXCURSION PASSIVE RADIATOR

(75) Inventors: Calvin C. Perkins, Portland, OR (US); Terry L. Wetherbee, Bothell, WA (US); David D. Bie, Indian Rocks Beach, FL (US)

(73) Assignee: Mackie Designs Inc., Woodinville, WA (US)

( * ) Notice: Under 35 U.S.C. 154(b), the term of this patent shall be extended for 0 days.

(21) Appl. No.: 09/370,972

(22) Filed: Aug. 9, 1999

Related U.S. Application Data

(63) Continuation of application No. 09/118,507, filed on Jul. 17, 1998, now abandoned.

(60) Provisional application No. 60/053,171, filed on Jul. 18, 1997.

(51) Int. Cl.[7] ..... G10K 13/00

(52) U.S. Cl. ..... 181/173; 181/171; 381/398; 381/425; 381/431

(58) Field of Search ..... 181/170, 171, 181/172, 173; 381/423, 424, 425, 431, 398

(56) References Cited

U.S. PATENT DOCUMENTS 3,669,215 * 6/1972 Kikuchi et al. ..... 181/171
5,892,184 * 4/1999 D' Hoogh ..... 181/171

* cited by examiner

*Primary Examiner*—Khanh Dang
(74) *Attorney, Agent, or Firm*—Christensen O'Connor Johnson Kindness PLLC

(57) ABSTRACT

A passive radiator assembly for a speaker that substantially reduces diaphragm resonance in the operating frequency range of the device. The new passive radiator assembly includes a quasi-elliptical shaped laminated honeycomb diaphragm, which is damped by an integral outer compliance (suspension) made of an elastomeric material that covers the entire upper surface of the diaphragm. The integrated outer compliance is of a progressive type, having a stiffness that increases in a controlled fashion during large excursions. To prevent non-linear rocking movements and compensate for displacement non-linearities, at least one, and preferably two, opposed spiders supported by a spider assembly frame are used to provide a restoring force applied to the diaphragm.

28 Claims, 6 Drawing Sheets

FIG. 1
PRIOR ART
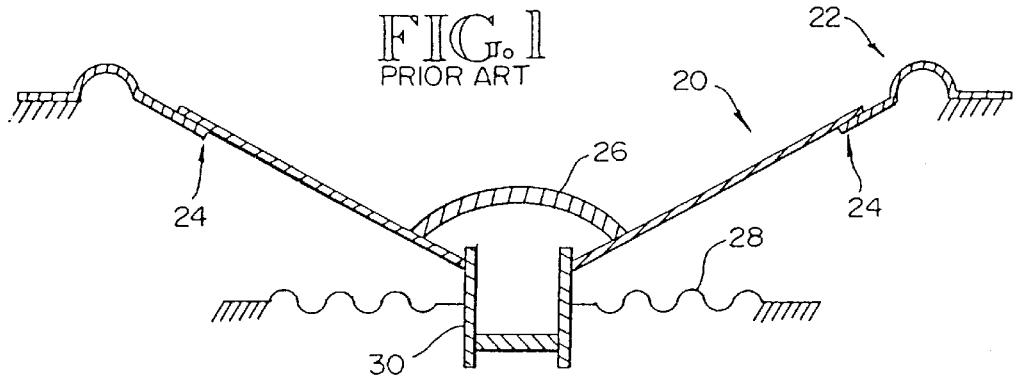
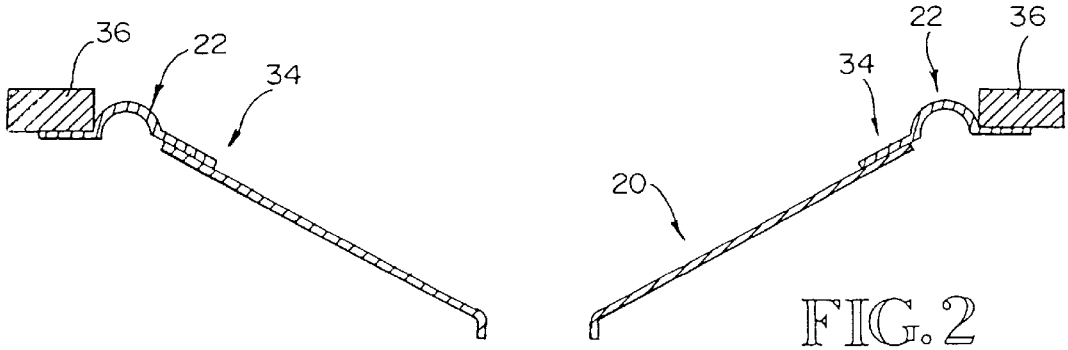
FIG. 2
PRIOR ART
FIG. 3
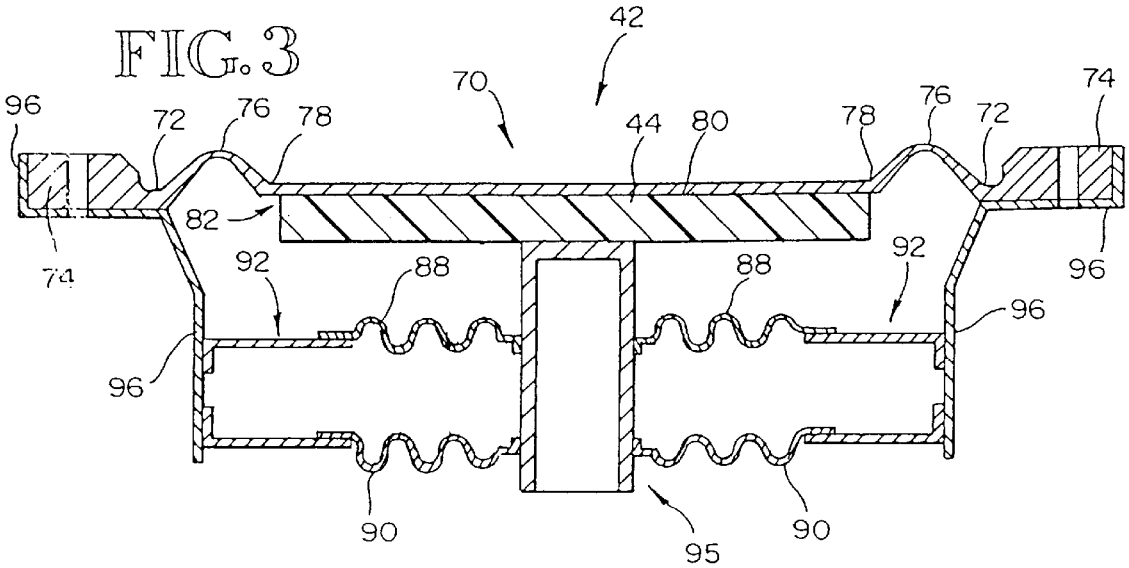

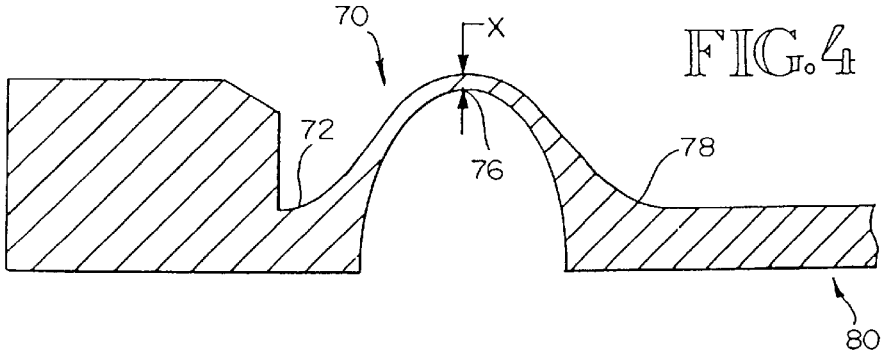
FIG. 4
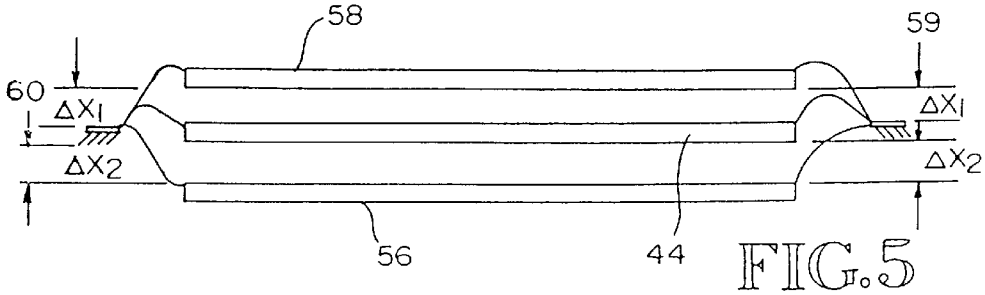
FIG. 5
FIG. 6
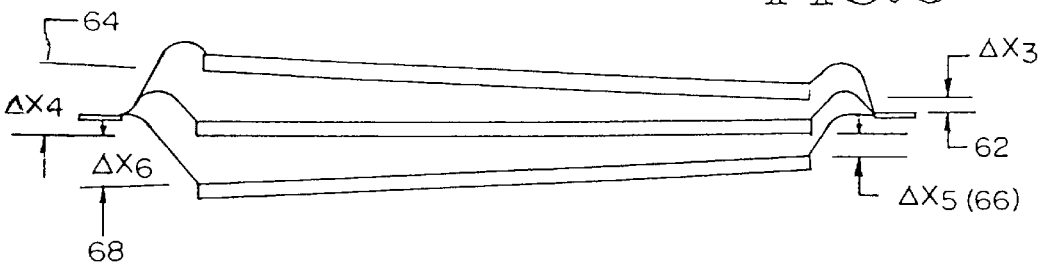
FIG. 7A
PRIOR ART
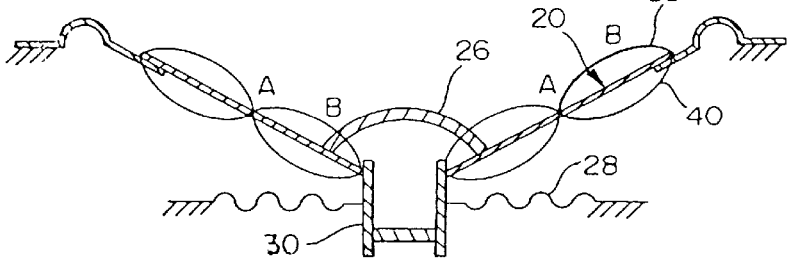

FIG. 7B
PRIOR ART
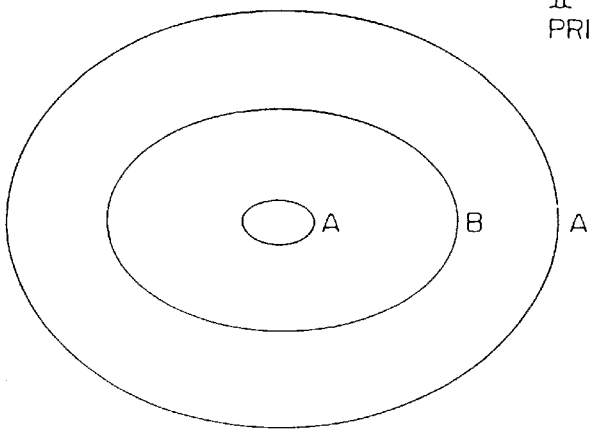
FIG. 8A
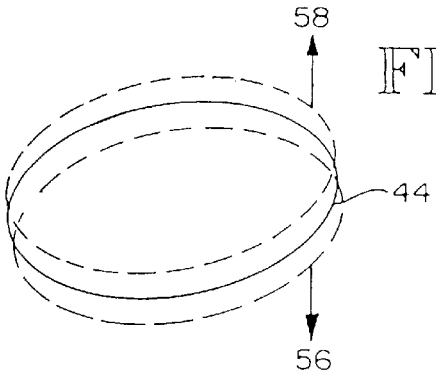
FIG. 8B
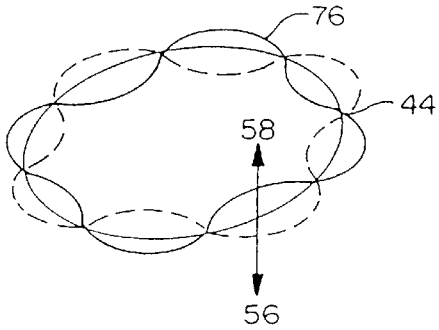
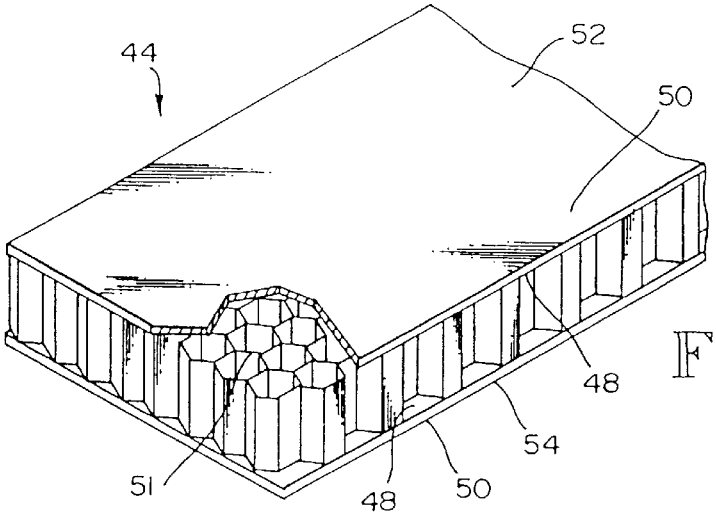
FIG. 9

FIG. 10
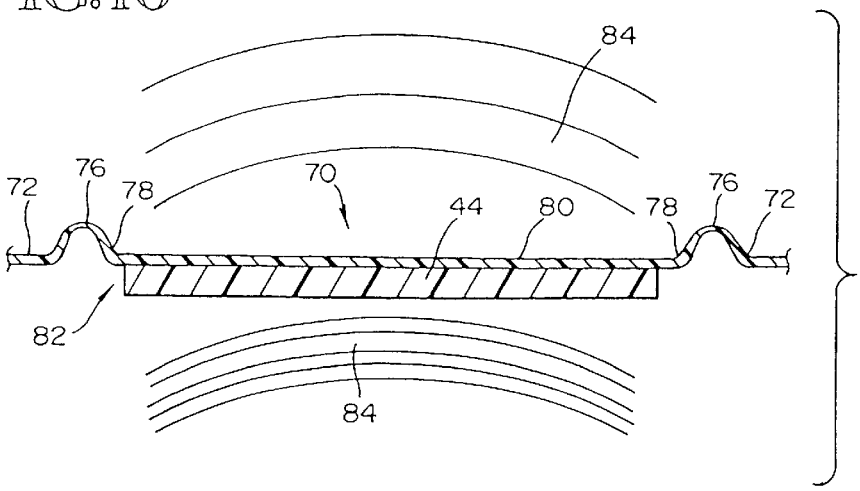
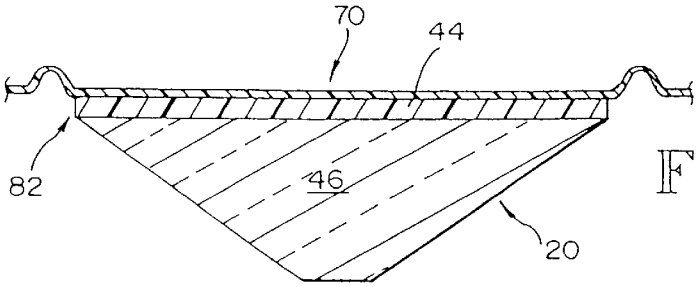
FIG. 11
FIG. 12
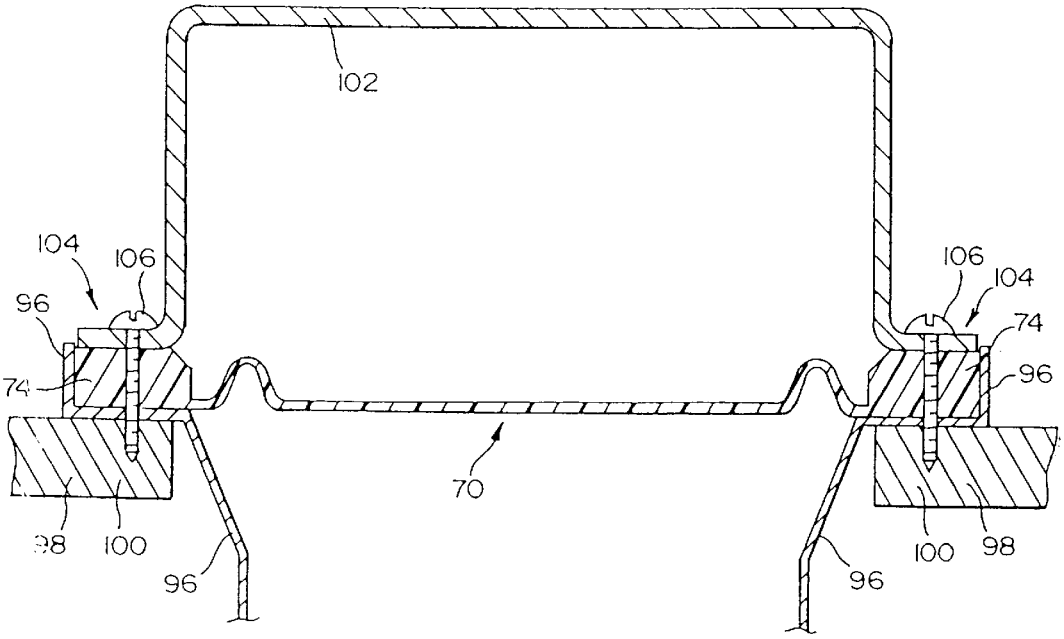

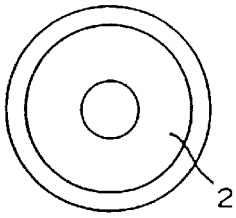
FIG. 13A
PRIOR ART
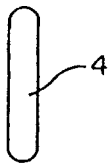
FIG. 13B
PRIOR ART
FIG. 13C
PRIOR ART
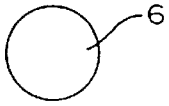
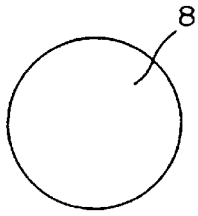
FIG. 13D
PRIOR ART
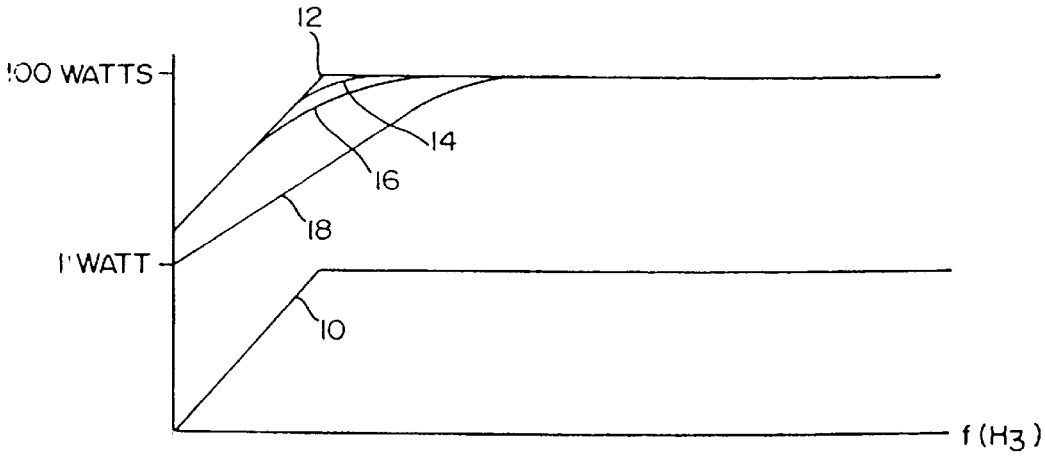
FIG. 14
PRIOR ART

PISTONIC MOTION, LARGE EXCURSION PASSIVE RADIATOR

RELATED APPLICATION

This application is a continuation of U.S. application Ser. No. 09/118,507, filed Jul. 17, 1998, now abandoned, which claims priority to U.S. provisional application Ser. No. 60/053,171, filed Jul. 18, 1997, and entitled "Pistonic Motion, Large Excursion Passive Radiator," and is hereby incorporated by reference.

TECHNICAL FIELD

The present invention generally relates to a passive radiator for a speaker, and more specifically, to a passive radiator that is tuned to provide an optimum low frequency output and high frequency attenuation of the sound energy from the passive radiator by stiffening a diaphragm of the radiator.

BACKGROUND OF THE INVENTION

Passive radiators, also known as drone cones or assisted-bass resonators, have been commercially available for over 37 years, as noted in the 1954 *Journal of Audio Engineering Society*, by Harry F. Olson et al. (Vol. II, No. 4, p. 219). A passive radiator loudspeaker system is a direct radiator system that uses an enclosure with a driven loudspeaker and an undriven suspended diaphragm, similar to the diaphragm of the driven speaker. The term "driven loudspeaker" refers to a cone and diaphragm assembly actuated by an electromagnetic signal to move air and, thus, produce sound. In contrast, an "undriven" or passive radiator consists only of a cone and diaphragm and does not include an electromagnetic activator or driver. However, a passive radiator's diaphragm and cone are moved in a secondary or passive response by the air pressure variation in the enclosure produced by the movement of the driven loudspeaker cone.

The principle use for the passive radiator is to replace the mass and stiffness of the air in a vented loudspeaker with a mechanical equivalent in a sealed enclosure that requires less enclosure volume than a vented system. A passive radiator, thus, substantially reduces the size of the enclosure that is required for a loudspeaker system while obtaining tuning equivalent to that achieved by a vent.

Loudspeakers, or powered speakers, require vents, or ports, to accommodate the varying air volume by enabling air pressure to be released in the loudspeaker enclosure, which have been produced by the oscillations of the cone of the driven loudspeaker. A large diameter vent requires considerable length, and therefore, a larger enclosure to house the vent. For example, a typical eight-inch, two-way loudspeaker system has a front baffle size of approximately 10 by 15 inches. To obtain linear low frequency power response from a vented loudspeaker system, the vent area must be at least one-half the diaphragm area. To meet this requirement, the size of the baffle that is used must be increased, Also, the vent must be properly sized such that it is large enough to function without creating vent noise, but small enough to minimize the physical size of the speaker enclosure. If the vent is too small, air velocity through the vent increases causing vent noise. Small vents also suffer from high turbulence during reproduction of musical material and/or sound that includes any loud or low bass content. In addition, sizing a vent too small causes vent power compression, which results in the loss of low frequency output from the loudspeaker system.

FIGS. 13A–13D illustrate some typical vent openings of varying size relative to a cone area of the speaker used. In FIG. 13A, the speaker 2 has a diaphragm or cone area $A_0$, and three vent sizes 4,6, and 8, which are shown in FIGS. 13B–13D, respectively. Vent 4 has an area of 0.1 $A_0$, vent 6 has an area of 0.25 $A_0$, and vent 8 has an area of 0.5 $A_0$. Lines 10, 12, 14, 16 and 18 as shown in graph FIG. 14 illustrate the relative corresponding frequency response for the different vent sizes of FIGS. 13A–13D for both large and small signals (i.e., one watt and 100 watts). Line 10 is a small signal response curve for all vents. Line 12 is vent area $A_0$, line 14 is vent area 0.5 $A_0$, line 16 is vent area 0.15 $A_0$, and line 18 is vent area 0.1 $A_0$. Based on the graph shown in FIG. 14, it will be apparent that a small vent causes a reduction in low frequency output at high power levels. Thus, vent power compression should be avoided to achieve reasonable acoustic output at low frequencies.

A passive radiator is beneficial in that a smaller speaker enclosure can be used. This is because the passive radiator provides a mechanism that is a substitute for vents, while consuming less volume. At low frequencies, a passive radiator diaphragm, which is the key component of the passive radiator, moves in response to pressure (sound) variations in a sealed speaker enclosure in a manner similar to the movement of a mass of air through the vent in a vented system. Because of the similarity of a passive radiator to a vent, a passive radiator performs like a properly sized vent if the passive radiator has sufficient linear excursion (length of travel), does not exhibit diaphragm breakup, and there is sufficient compliance (also known as suspension).

There are both technical and marketing reasons to use a passive radiator in a loudspeaker system. Recently, speaker systems employing passive radiators have become popular due to marketing efforts, rather than for technical reasons. When a passive radiator is used in a system, it appears as if the speaker system has more speakers. Usually, a passive radiator is the same size as the driven speaker, and from outward appearance, looks very similar to the driven speaker. As mentioned previously, however, the passive radiator does not have a voice coil and magnet assembly (i.e., it does not include a driver assembly). The purpose of a passive radiator is to serve as substitute for a vent. This enables the use of a smaller speaker enclosure for equivalent low frequency performance. Because the speaker enclosures have become smaller, many users place the speakers on a bookshelf, which takes up less room than traditional large speakers.

An important consideration for proper functional operation of a passive radiator is that it exhibits true pistonic motion over its entire design frequency range, and accommodate a very large linear excursion. Pistonic motion means that the entire diaphragm and suspension (compliance) move back and forth to displace air substantially the same distance, in the same direction, at the same time. This movement replicates the reciprocal movement of a piston. Linear excursion refers to the length of travel of the radiator assembly. Both effective pistonic motion and relatively large linear excursion are very difficult to achieve with conventional passive radiator technology.

FIG. 1 shows a cut-away of a conventional prior art passive radiator consisting of a cone 20, and an outer means 22 for suspending the cone (also referred to as a compliance), which is attached to the back surface 24 of cone 20. Conventional passive radiator also includes a dust cap 26, a singular spider 28, which supplies most of the mechanical restoring force to cone 20, a voice coil form 30, and a mass ring 32 that comprises additional mass used to tune the system. FIG. 2 shows an alternative method for attaching compliance 22 over the front surface 34 of cone 20 such that compliance 22 extends between cone 20 and a mounting gasket 36. The speaker frame is not shown in either of these figures.

Typical passive radiators have problems with diaphragm breakup, or non-pistonic motion, as illustrated in FIGS. 7A and 7B. FIG. 7A shows a standing wave of one degree of freedom across the diaphragm. One full wave length is shown. Peak displacement of the standing wave occurs at 38 and 40 in FIG. 7A. Standing waves 38 and 40 are shown with maximum peak amplitude at points "B" and minimum peak amplitude at points "A". FIG. 7B is the plan view of the standing wave breakup phenomena illustrated in FIG. 7A. Passive radiator designs should minimize or eliminate the development of such standing waves.

Another serious design challenge in passive radiators is minimizing the many different breakup modes of the outer compliance, which produces undesirable audible effects. FIG. 8A illustrates the ideal performance of the outer compliance for both inward and outward displacements. In FIG. 8A, all points on the compliance rim move together. FIG. 8B shows the effects of compliance breakup in a rim resonance mode of operation, during large excursions. In some cases, the compliance will actually move out of phase for in the opposite direction), relative to the radiator's diaphragm.

Clearly, a new passive radiator is needed that will reduce the inherent problems of typical passive radiators to below the threshold of audibility. The new passive radiator would thus permit large excursions and will minimize breakup in either the diaphragm or compliance.

SUMMARY OF THE INVENTION

The present invention is directed to a passive radiator that provides a substitute for a traditional speaker vent while consuming considerably less volume. Additionally, the passive radiator of the present invention is designed for large excursions (length of travel of the radiator) and to minimize "breakup" in a rim resonance mode of operation.

The passive radiator of the present invention is capable of emitting large excursions and is used in combination with a speaker that is contained within a speaker enclosure. The passive radiator assembly includes a substantially planar diaphragm having a layer of honeycombed material sandwiched between a pair of spaced-apart outer skins. In a preferred form, the diaphragm is quasi-elliptical in shape.

A compliance assembly including a frame, which is connected to the speaker enclosure, and a progressive-type compliance. The progressive-type compliance is of a size and shape to contact and adhere to one of the outer skins of the diaphragm such that the combined diaphragm and compliance have a stiffness that increases in a controlled fashion during large excursions.

The compliance and compliance frame are mounted to the speaker enclosure such that the passive radiator within the compliance frame is contained within a generally sealed enclosure within the speaker enclosure.

The passive radiator assembly further includes a spider assembly having at least one spider mounted within a spider assembly frame. The spider is attached to the diaphragm through a support member to provide a restoring force to the diaphragm when the diaphragm resonates in an operating frequency. Preferably, the support member is a piston support tube.

In another preferred embodiment, there are two opposing spiders attached to the support member, and ultimately to the diaphragm.

In the preferred embodiment, the compliance includes a periphery having varying thicknesses (of a largest cross-sectional area) from its radially most outer point having a largest cross-sectional area, decreasing to a radially inward direction to its smallest cross-sectional area (and thinnest point), and then increasing to a radially inward cross-sectional area in between that of the radially outermost point largest cross-sectional area and the smallest cross-sectional area.

In preferred form, the thickness at the largest cross-sectional area at the radially outermost point of the compliance is approximately 7 mm. The thinnest point of the smallest cross-sectional point radially inward of the radially outermost point is approximately 0.75 mm. The compliance thickness decreases radially inward from the thinnest point to a thickness of approximately 2 mm. The compliance also forms a central planar portion radially inward of the thinnest point or smallest cross-sectional area. The central planar portion contacts and adheres to the outer skin of the diaphragm.

The compliance is preferably made of an elastomeric material. The hardness of the compliance is in the 40 to 60 durometer range and allows for over +/−10 mm of suspension travel.

In another embodiment, the compliance is molded to accommodate an adjacent and peripheral gasket that is supported by the compliance frame.

These and other features will be more fully discussed in the Description of the Preferred Embodiment and when viewed in relation to the various figures of the drawing.

BRIEF DESCRIPTION OF THE DRAWING

Like reference numerals are used to denote like parts throughout the several figures of the drawing. The foregoing aspects and many of the attendant advantages of this invention will become more readily appreciated as the same becomes better understood by reference to the following detailed description, when taken in conjunction with the accompanying drawing, wherein:

FIG. 1 (PRIOR ART) shows the cross-section of a typical passive radiator;

FIG. 2 (PRIOR ART) shows an alternative placement for attaching the outer compliance and showing an adjacent gasket;

FIG. 3 is a cross-sectional side view of the passive radiator assembly takes substantially along lines 3—3 of FIG. 15 in accordance with the present invention;

FIG. 4 is an enlarged cross-sectional view of the integrated compliance, which is the acoustic-damping material of the passive radiator shown in FIG. 3;

FIG. 5 is a diagram illustrating ideal pistonic (linear) motion;

FIG. 6 is a diagram illustrating a rocking motion set up by a rim-resonances and other non-linearities in the compliance of a radiator;

FIGS. 7A and 7B (PRIOR ART) are respectively an edge view and plan view diagrams showing non-pistonic diaphragm breakup modes;

FIG. 8A is a diagram illustrating a "no breakup mode" of the outer compliance during large excursions;

FIG. 8B is a diagram illustrating compliance breakup phenomena known as rim-resonance;

FIG. 9 is a cut-away isometric view of a composite honeycomb sandwiched planar diaphragm used in the present invention;

FIG. 10 is a cross-sectional side view of the radiator illustrating the effect of an additional acoustic damping provided by the compliance;

FIG. 11 is a cross-sectional side view of the radiator showing the net savings in internal speaker enclosure volume achieved by using a planar diaphragm rather than the traditional cone;

FIG. 12 is a cross-sectional elevational view of the passive radiator of the present invention and electronics/heat sink housing mounted over the passive radiator and also disclosing a plurality of shock mount joints securing the electronic housing to a rear panel of the loudspeaker enclosure;

FIG. 13A–13D (PRIOR ART) are various diagrams comparing the speaker cone area with different sizes and shapes of vents (or ports);

FIG. 14 (PRIOR ART) is a frequency vs. amplitude graph showing the effects of vent size on frequency response at high power levels as compared to the small signal (1 watt) frequency response for all vent sizes;

DESCRIPTION OF THE PREFERRED EMBODIMENT

Figure 15A:
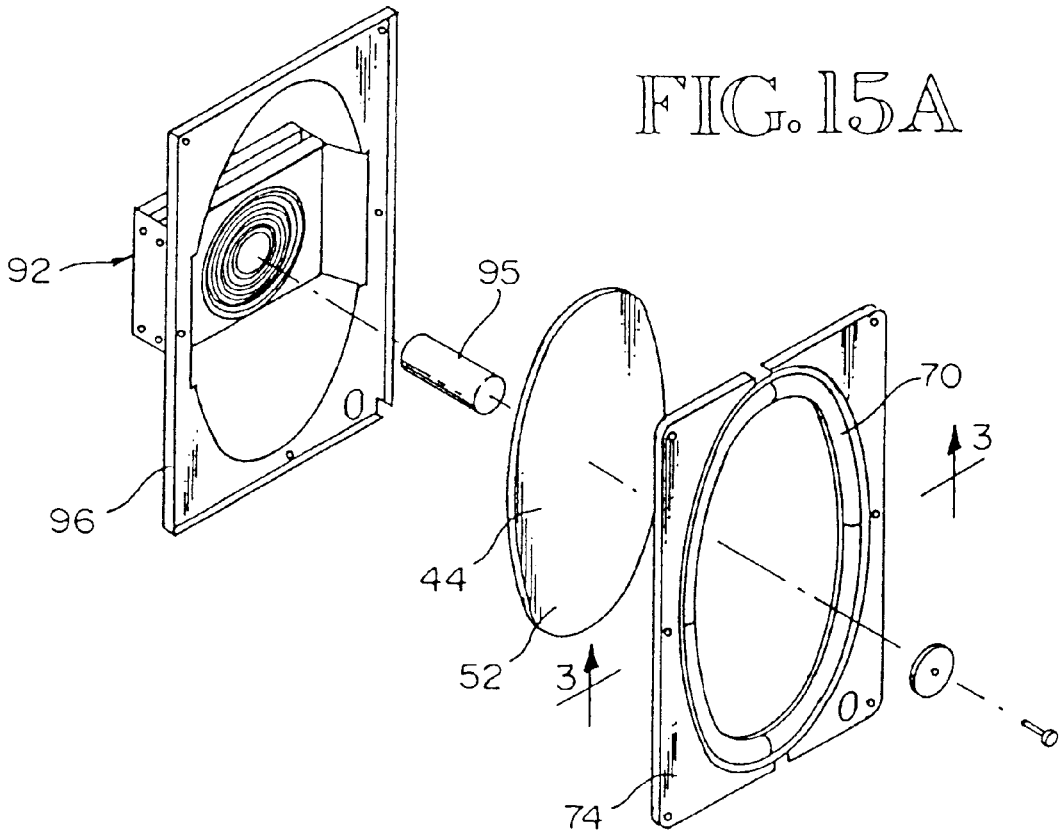
FIG. 15A is an exploded perspective assembly view of the passive radiator assembly in accordance with the present invention and better showing the compliance frame, the diaphragm, a piston actuator, and a spider assembly.

An ideal passive radiator should emulate the performance of a vent having an equivalent area, without introducing audible noise caused by suspension and diaphragm breakup. In addition, the passive radiator diaphragm should also be acoustically opaque to higher sound frequencies in the enclosure, thus preventing their transmission from the enclosure through the diaphragm into the ambient environment. The passive radiator should also occupy as small and internal volume as possible so that size of the speaker enclosure is minimized.

Referring to FIGS. 9–11, the present invention relates to a passive radiator 42 having a planar diaphragm 44, which is substituted for traditional cone 20. The use of diaphragm 44 saves internal volume 46 consumed by prior art passive radiator devices. This is best shown in FIG. 11 where a traditional cone 20 used in current passive radiator devices is juxtaposed over the present invention to show the savings 46 in enclosure volume that is achieved by the present invention.

Both the size and shape and the material used for the passive radiator's diaphragm 44 are of key importance in determining its performance. A quasi-elliptical shaped disk is the preferred embodiment for diaphragm 44, which eliminates the propensity for any axis-symmetric breakup modes. Referring also to FIG. 9, a composite honeycomb layer 51 is sandwiched between an upper surface 48 and a lower surface 50 of diaphragm 44. Skins 52 and 54 cover honeycomb material 51. Each skin has an inner surface 48 and an outer surface 50. The diaphragm works in concert with the honeycomb material that is preferably fabricated from aluminum foil, and skins 52 and 54 are preferably formed of a phenolic resin material. This results in a very light, rigid piston diaphragm and has the following advantages: (1) very high rigidity, (2) low moving mass, (3) effectively acts as a piston in the frequency range of operation, (4) minimizes the internal volume occupied by the passive radiator, and (5) axis-symmetric resonances are minimized.

The displacement of the passive radiator diaphragm is controlled by the suspension (compliance). It can be shown that for the same area, diaphragm 44 of passive radiator 42 is required to have about twice the displacement of a driven cone. At high peak excursions, the diaphragm displacement should be pistonic, or parallel planar, as shown in FIG. 5. This figure shown the maximum inward displacement 56, the maximum outward displacement 58, and an "at rest" position 60, all of which are based on a value of x, shown at 76, which is a part of the compliance, and discussed below. If the motion is pistonic, linear, and reciprocal, peak displacements $\Delta X_1$ and $\Delta X_2$, are equal at all places around the circumference of the diaphragm, relative to the rest position of diaphragm 44, which is typically on the order of 8 to 10 mm. FIG. 6 shows suspension non-linearities 62 ($\Delta X_3$), 64 ($\Delta X_4$), 66 ($\Delta X_5$), and 68 ($\Delta X_6$), where unequal displacement distances can cause undesirable rocking motion of the diaphragm.

To prevent such types of non-linearities, a progressive variable rate outer compliance 70 was developed for use in the preferred embodiment of the present invention, as shown in FIG. 4. The suspension or compliance material varies in cross-sectional area and thickness from its radially outer most point 72, adjacent to a built-in shock mount gasket 74 (FIG. 3). The compliance has a maximum thickness at that point of approximately 7 mm. The cross-sectional area and thickness continually decreases to its thinnest point 76 and smallest cross-sectional area, also known as x, discussed above. The thickness at point 76 is approximately 0.75 mm. The compliance then gradually increases to a point 78, which is about 2 mm in thickness. Of equal importance are the mechanical properties of the elastomeric material chosen for the compliance. The material used for the compliance has hardness in the 40 to 60 durometer range and allows over +/−10 mm of suspension travel (large excursion) for a 45 square inch pistonic diaphragm.

Rather than attaching to only the perimeter of the diaphragm as it typically is done with conically shaped prior art diaphragm assemblies, such as shown in FIGS. 1 and 2 (compliance 22), compliance 70 of the present invention has a solid diaphragm damping portion 80 as shown in FIGS. 3 and 4. Solid diaphragm damping portion 80 is adhered (e.g., glued) over the entire upper surface 48 of the honeycombed diaphragm 44. This creates a combined diaphragm/compliance sandwich assembly where the extended elastomer compliance over the piston proper further dampens sound transmission through a diaphragm assembly.

FIG. 10 illustrates the attenuation of high frequency sound propagated through the passive radiator diaphragm. Curved lines 84 and 86 in FIG. 10 represent sound (pressure) waves. Sound waves 84 act upon diaphragm 44 of the passive radiator, causing it to resonate. The diaphragm absorbs or attenuates the higher frequency waves. The passive radiator device can therefore be "tuned" to provide the optimum low frequency output and high frequency attenuation by selectively damping the diaphragm.

Figure 15B:
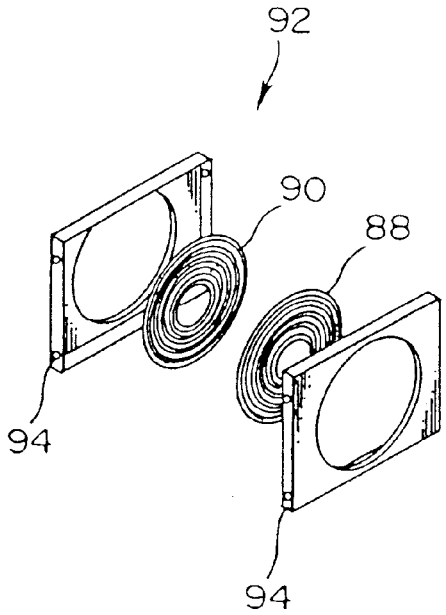
FIG. 15B is an enlarged perspective view of the spider assembly.

With reference to the view of the preferred embodiment for the present invention shown in FIGS. 3, 15A and 15B, two opposing spiders 88 and 90 center the diaphragm and compliance relative to a frame 96 and provide most of the spring restoration force for diaphragm 44 of the passive radiator. A molded piston support tube 95, as shown in FIG. 3, couples spiders 88 and 90 to diaphragm 44 which is acting as a piston in concert with the damped surface 82. Thus, pistonic motion is obtained in the present invention passive radiator.

Since the spiders 88 and 90 are opposing each other, any non-linear restoring force tends to be canceled out. The use of two or more spiders in a passive radiator provides benefits not realized in prior art devices. Because the outer suspension or compliance is relatively loose, the use of two spiders minimizes any tendency for a rocking moment, as shown in FIG. 6. The spiders 88 and 90 are a part of a spider assembly 92, which includes a spider assembly frame 94. This is best shown in FIGS. 15A and 15B.

The concept of using an extended portion of the outer compliance to acoustically dampen the diaphragm is also applied to a mounting gasket as well. FIG. 2 shows the typical placement of a mounting gasket 36 on top of the compliance in a prior art passive radiator. This disposition of the mounting gasket is done for cosmetic and mechanical reasons. If the diaphragm is mounted in the rear of the enclosure, then the gasket is necessary to fit the compliance to the speaker frame. If front mounted, then a gasket is typically used only for cosmetic, not functional, purposes. Because of the viscous losses and damping properties of the material in the present invention, the compliance 70 is molded to incorporate the mounting gasket 74 as shown in FIG. 3. However, due to its expanded functionality in the present invention, the mounting gasket 74 is referred also as a shock mount pad.

In use, the passive radiator assembly of the present invention is mounted within a speaker enclosure 98. More particularly, the passive radiator assembly is preferably mounted to a back panel 100 of speaker enclosure 98. This mounting is such that a sealed enclosure is formed where the passive radiator is mounted to the speaker enclosure.

An electronics/heat sink housing 102 be mounted to back panel 100 of speaker enclosure 98 over passive radiator 42 and any other electronics (not shown) that are required to operate the speaker. The electronic/heat sink housing may be like that described in applicant's co-pending U.S. application Ser. No. 09/118,508, claiming priority to U.S. provisional patent application Ser. No. 60/053,065, filed Jul. 18, 1997, and entitled "Passive Radiator Cooled Electronics Housing/Exchanger for a Speaker," and is hereby incorporated by reference. If such electronics/heat sink housing is used, a plurality of shock mount joints 104 may be used to mount electronic housing 102 over the compliance 70 and to speaker enclosure 98. Each shock mount joint 104 includes a fastener 106 that extends through the electronics/heat sink housing 102, through the compliance frame 96 in between gasket 74 and compliance 70, and into speaker enclosure 98.

The illustrated and described embodiments are presented by way of example. The scope of protection is not to be limited by these examples. Rather, any patent protection is to be determined by the claims which follow, construed in accordance with established rules of patent claim construction, including the use of doctrine of equivalents and reversal of parts.

What is claimed is:

1. A passive radiator assembly capable of emitting large excursions for a speaker contained within a speaker enclosure, said passive radiator assembly comprising:

a substantially planar diaphragm having a layer of honeycombed material sandwiched between a pair of spaced apart outer skins that covers the diaphragm;

a compliance assembly including a frame, which is connected to the speaker enclosure, and a progressive-type compliance, which is of a size and shape to contact and adhere to one of the outer skins of the diaphragm such that the combined diaphragm and compliance have a stiffness that increases in a controlled fashion during large excursions;

wherein the compliance and compliance frame are mounted relative to the speaker enclosure such that the passive radiator within the compliance and compliance frame is contained within a generally sealed enclosure within the speaker enclosure; and a spider assembly having at least one spider mounted within a spider assembly frame such that the at least one spider is attached to a support member, which is connected to the diaphragm, in order to provide a restoring force to the diaphragm when the diaphragm resonates in an operating frequency.

2. The passive radiator assembly according to claim 1, wherein the diaphragm is quasi-elliptical in shape.

3. The passive radiator assembly according to claim 1, wherein the compliance includes a periphery having varying thickness from its radially outermost point having a maximum thickness of the compliance, and decreasing in the radially inward direction to a thinnest point of the compliance, and then increasing thickness radially inward of the thinnest point to a thickness less than the maximum thickness of the radially outermost point and greater than the thickness of the thinnest point.

4. The passive radiator assembly according to claim 3, wherein the maximum thickness of the compliance at the radially outer most point is approximately 7 mm.

5. The passive radiator assembly according to claim 3, wherein the thinnest cross-sectional point of the compliance is approximately 0.75 mm.

6. The passive radiator assembly according to claim 3, wherein the compliance radially inwardly of the thinnest point is approximately 2 mm in thickness.

7. The passive radiator assembly according to claim 3, wherein compliance forms a substantially uniformly sized central planar portion that is radially inward of the thinnest point of the compliance, said central planar portion contacts and adheres to the one outer skin of the diaphragm.

8. The passive radiator assembly according to claim 1, wherein the compliance is formed from an elastomeric material.

9. The passive radiator assembly according to claim 3, wherein the compliance is an elastomeric material.

10. The passive radiator assembly according to claim 1, wherein the compliance has a hardness in the 40 to 60 durometer range and allows over +/−10 mm of suspension travel.

11. The passive radiator assembly according to claim 8, wherein the compliance has a hardness in the 40 to 60 durometer range and allows over +/−0 mm of suspension travel.

12. The passive radiator assembly according to claim 1, further comprising a gasket supported by the compliance frame and is mounted adjacent and peripherally of the compliance.

13. The passive radiator assembly according to claim 1, wherein there are two opposed spiders attached to the support member.

14. The passive radiator assembly according to claim 1, wherein the support member is a piston support tube.

15. The passive radiator assembly according to claim 13, wherein the support member is a piston support tube.

16. A passive radiator assembly capable of emitting large excursions for a speaker contained within a speaker enclosure, said passive radiator assembly comprising:

a substantially planar diaphragm;

a compliance assembly including a frame, which is connected to the speaker enclosure, and a progressive-type compliance, which is of a size and shape to contact and adhere to the diaphragm such that the combined diaphragm and compliance frame have a stiffness that increases in a controlled fashion during large excursions;

wherein the compliance and compliance frame are mounted relative to the speaker enclosure such that the passive radiator within the compliance and compliance frame is contained within a generally sealed enclosure within the speaker enclosure; and a spider assembly having at least one spider mounted within a spider assembly frame such that the at least one spider is attached to a support member, which is connected to the diaphragm, in order to provide a restoring force to the diaphragm when the diaphragm resonated in an operating frequency.

17. The passive radiator assembly according to claim 16, wherein the substantially planar diaphragm includes a layer of honeycombed material sandwiched between a pair of spaced apart outer skins that covers the diaphragm, and wherein the progressive-type compliance adheres to one of the outer skins of the diaphragm.

18. The passive radiator assembly according to claim 16, wherein the diaphragm is quasi-elliptical in shape.

19. The passive radiator assembly according to claim 16, wherein the compliance includes a periphery having varying thickness from its radially outermost point having a maximum thickness of the compliance, and decreasing in the radially inward direction to a thinnest point of the compliance, and then increasing thickness radially inward of the thinnest point to a thickness less than the maximum thickness of the radially outermost point and greater than the thickness of the thinnest point.

20. The passive radiator assembly according to claim 19, wherein the maximum thickness of the compliance at the radially outermost point is approximately 7 mm.

21. The passive radiator assembly according to claim 19, wherein the thinnest cross-sectional point of the compliance is approximately 0.75 mm.

22. The passive radiator assembly according to claim 19, wherein the compliance radially inwardly of the thinnest point is approximately 2 mm in thickness.

23. The passive radiator assembly according to claim 16, wherein the compliance is an elastomeric material.

24. The passive radiator assembly according to claim 19, wherein the compliance is an elastomeric material.

25. The passive radiator assembly according to claim 16, wherein the compliance has a hardness in the 40–60 durometer range and allows over +/−10 mm of suspension travel.

26. The passive radiator assembly according to claim 16, further comprising a gasket supported by the compliance frame and is mounted adjacent and peripherally of the compliance.

27. The passive radiator assembly according to claim 16, wherein there are two opposed spiders attached to the support member.

28. The passive radiator assembly according to claim 16, wherein the support member is a piston support tube.

* * * * *

UNITED STATES PATENT AND TRADEMARK OFFICE

CERTIFICATE OF CORRECTION

PATENT NO. : 6,176,345 B1
DATED : January 23, 2001
INVENTOR(S) : C.C. Perkins et al.

It is certified that error appears in the above-identified patent and that said Letters Patent is hereby corrected as shown below:

Title Page,
Item [56], References Cited, "D' Hoogh" should read -- D'Hoogh --

Column 8,
Line 48, "+/-0" should read -- +/-10 --

Column 10,
Lines 18-19, "durom- eter" should break as follows: -- duro- meter --

Signed and Sealed this

Twenty-fifth Day of September, 2001

*Attest:*

Nicholas P. Godici

NICHOLAS P. GODICI
*Acting Director of the United States Patent and Trademark Office*

*Attesting Officer*